US009207004B2

(12) United States Patent
Higashiiue et al.

(10) Patent No.: US 9,207,004 B2
(45) Date of Patent: Dec. 8, 2015

(54) REFRIGERATION CYCLE APPARATUS

(75) Inventors: Shinya Higashiiue, Chiyoda-ku (JP); So Nomoto, Chiyoda-ku (JP); Hirokazu Minamisako, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 542 days.

(21) Appl. No.: 13/636,304

(22) PCT Filed: Jan. 26, 2011

(86) PCT No.: PCT/JP2011/051468

§ 371 (c)(1),
(2), (4) Date: Sep. 20, 2012

(87) PCT Pub. No.: WO2011/135876

PCT Pub. Date: Nov. 3, 2011

(65) Prior Publication Data

US 2013/0025305 A1 Jan. 31, 2013

(30) Foreign Application Priority Data

Apr. 27, 2010 (JP) ..... 2010-101857

(51) Int. Cl.
*F25B 41/00* (2006.01)
*F25B 31/00* (2006.01)
(Continued)

(52) U.S. Cl.
CPC ..... *F25B 41/00* (2013.01); *F25B 31/004* (2013.01); *F25B 5/04* (2013.01); *F25B 13/00* (2013.01);
(Continued)

(58) Field of Classification Search
CPC ..... F25B 1/06; F25B 2341/0012; F25B 2341/0016; F25B 2341/0011; F25B 31/002; F25B 43/02; F25B 43/00
USPC ..... 62/470, 473, 84
See application file for complete search history.

(56) References Cited

U.S. PATENT DOCUMENTS 320,307 A * 6/1885 Suckert ..... 62/84
6,000,233 A 12/1999 Nishida et al.
(Continued)

FOREIGN PATENT DOCUMENTS

JP 3-282159 A 12/1991
JP 4-110575 A 4/1992
(Continued)

OTHER PUBLICATIONS

First Office Action issued on Apr. 2, 2014, by the Chinese Patent Office in corresponding Chinese Patent Application No. 201180020973.6 (19 pages).
(Continued)

*Primary Examiner* — Cassey D Bauer
(74) *Attorney, Agent, or Firm* — Buchanan Ingersoll & Rooney PC

(57) ABSTRACT

Refrigerating machine oil is reliably returned to a compressor, regardless of whether the oil is miscible or immiscible with a refrigerant. A first refrigerant channel includes a compressor, a condenser, a first flow control valve, a refrigerant storing container, a second flow control valve, and a first evaporator are connected in that order. A refrigerant outlet of the first evaporator is connected to a suction refrigerant inlet of an ejector. A second refrigerant channel includes a compressor and a second evaporator connected in that order. A refrigerant inlet of the second evaporator is connected to a mixed refrigerant outlet of the ejector. A third refrigerant channel branching off from a halfway point of a pipe connecting a refrigerant outlet of the radiator and the first flow control valve includes a third flow control valve and a motive refrigerant inlet of the ejector are connected in that order.

10 Claims, 13 Drawing Sheets

(51) Int. Cl.
*F25B 5/04* (2006.01)
*F25B 13/00* (2006.01)

(52) U.S. Cl.
CPC ... *F25B 2341/0011* (2013.01); *F25B 2400/053* (2013.01); *F25B 2400/054* (2013.01); *F25B 2400/13* (2013.01)

(56) References Cited

U.S. PATENT DOCUMENTS

| | | | | |
|---|---|---|---|---|
| 2005/0178150 | A1 | 8/2005 | Oshitani et al. | |
| 2007/0039349 | A1 | 2/2007 | Yamada et al. | |
| 2007/0271942 | A1 * | 11/2007 | Yokoyama et al. | 62/278 |

FOREIGN PATENT DOCUMENTS

| | | | |
|---|---|---|---|
| JP | 11-094380 | A | 4/1999 |
| JP | 2001-174091 | A | 6/2001 |
| JP | 2002-081803 | A | 3/2002 |
| JP | 2002-130874 | A | 5/2002 |
| JP | 2003-279177 | A | 10/2003 |
| JP | 2005-308380 | A | 11/2005 |
| JP | 2007-078340 | A | 3/2007 |
| JP | 2007-263440 | A | 10/2007 |
| JP | 2009-133613 | A | 6/2009 |
| JP | 2010-002134 | A | 1/2010 |

OTHER PUBLICATIONS

International Search Report (PCT/ISA/210) issued on Mar. 8, 2011, by the Japanese Patent Office as the International Searching Authority for International Application No. PCT/JP2011/051468.
Office Action issued on May 29, 2012, by the Japanese Patent Office for Application No. 2010-101857.
Japanese Office Action (Notice of Reasons for Rejection) dated Oct. 30, 2012, issued in corresponding Japanese Patent Application No. 2010-101857, and English language translation of Office Action. (5 pages).

* cited by examiner

REFRIGERATION CYCLE APPARATUS

TECHNICAL FIELD

The present invention relates to a refrigeration cycle apparatus including an ejector. For example, the present invention provides a highly reliable refrigeration cycle apparatus configured to avoid seizing of a shaft with heat due to running out of refrigerating machine oil in a shell of a compressor.

BACKGROUND ART

A conventional refrigeration cycle apparatus including an ejector is disclosed in Patent Literature 1 in which a gas-liquid separator provided at an outlet of the ejector has an oil return hole at the bottom thereof. The apparatus also includes a bypass in which the oil return hole and a suction port of a compressor are connected with a pipe.

In such a configuration, refrigerating machine oil residing at the bottom of the gas-liquid separator is made to return to the compressor. Therefore, seizing of the compressor with heat is prevented.

CITATION LIST

Patent Literature

Patent Literature 1: Japanese Unexamined Patent Application Publication No. 2002-130874 (Claim 1 and FIG. 1)

SUMMARY OF INVENTION

Technical Problem

In the conventional example, if refrigerating machine oil, such as polyalkylene glycol (PAG), that is immiscible with refrigerant is used, the liquid refrigerant and the refrigerating machine oil in the gas-liquid separator are separated from each other. Therefore, only the refrigerating machine oil can be made to return to the compressor. However, if miscible refrigerating machine oil, such as ether oil, that is soluble to liquid refrigerant is used, both the refrigerating machine oil and the liquid refrigerant return to the compressor. Therefore, the amount of refrigerating machine oil returned is reduced. Consequently, the oil in the compressor may run out.

Meanwhile, if the flow rate is increased so that the amount of oil to be returned is increased, a large amount of liquid refrigerant flows into the compressor. Hence, the pressure inside the compressor increases because of the compression with the liquid refrigerant. Consequently, the compressor may stop abnormally, or components of the compressor may be damaged.

It is an object of the present invention to provide a refrigeration cycle apparatus including an ejector in which refrigerating machine oil is reliably returned to a compressor, regardless of whether the refrigerating machine oil is miscible or immiscible with refrigerant.

Solution to Problem

A refrigeration cycle apparatus according to the present invention includes an ejector, the ejector including a motive refrigerant inlet into which a motive refrigerant flows, a suction refrigerant inlet into which a suction refrigerant flows, and a mixed refrigerant outlet out of which a mixed refrigerant as a mixture of the motive refrigerant and the suction refrigerant flows, the refrigeration cycle apparatus making the refrigerants circulate therethrough and comprising:

a first refrigerant channel in which a compressor, a radiator, a first flow control valve, a refrigerant storing container, a second flow control valve, and a first evaporator are connected in that order with pipes and in which a refrigerant outlet of the first evaporator is connected to the suction refrigerant inlet of the ejector with a pipe;

a second refrigerant channel in which the compressor and a second evaporator are connected in that order with a pipe and in which a refrigerant inlet of the second evaporator is connected to the mixed refrigerant outlet of the ejector with a pipe; and a third refrigerant channel branching off from a halfway point of the pipe connecting a refrigerant outlet of the radiator and the first flow control valve and in which a third flow control valve and the motive refrigerant inlet of the ejector are connected in that order with a pipe.

Advantageous Effects of Invention

The refrigeration cycle apparatus according to the present invention provides a refrigeration cycle apparatus including an ejector and in which refrigerating machine oil is reliably returned to a compressor, regardless of whether the refrigerating machine oil is miscible or immiscible with refrigerant.

DESCRIPTION OF EMBODIMENTS

Embodiment 1

Configuration of Refrigeration Cycle Apparatus 1010

Referring to FIGS. 1 to 8, Embodiment 1 will now be described.

Figure 1:
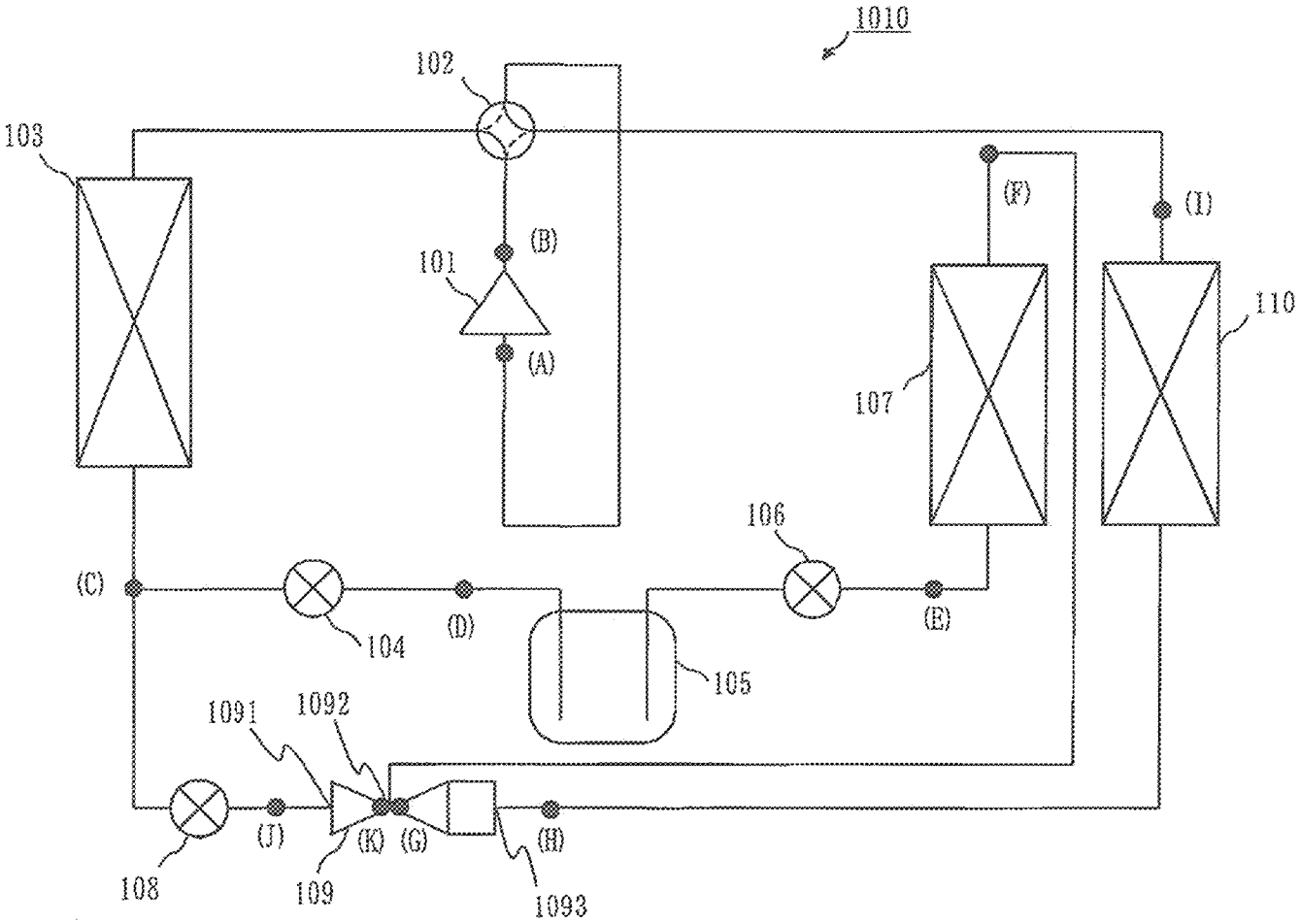
FIG. 1 is a refrigerant circuit diagram of a refrigeration cycle apparatus 1010 according to Embodiment 1.

FIG. 1 is a schematic diagram illustrating a configuration of a refrigeration cycle apparatus 1010 according to Embodiment 1. The refrigeration cycle apparatus 1010 includes an ejector 109. The ejector 109 includes a motive refrigerant inlet 1091 into which a motive refrigerant flows, a suction refrigerant inlet 1092 into which a suction refrigerant flows, and a mixed refrigerant outlet 1093 out of which a mixed refrigerant as a mixture of the motive refrigerant and the suction refrigerant flows.

The refrigeration cycle apparatus 1010 includes a first refrigerant channel in which a compressor 101, a condenser 103 as a radiator, a first flow control valve 104, a refrigerant storing container 105, a second flow control valve 106, and a first evaporator 107 are connected in that order with refrigerant pipes and in which a refrigerant outlet of the first evaporator 107 is connected to the suction refrigerant inlet 1092 of the ejector 109 with a pipe. The refrigeration cycle apparatus 1010 further includes a second refrigerant channel in which the compressor 101 and a second evaporator 110 are connected in that order with a refrigerant pipe and in which a refrigerant inlet of the second evaporator 110 is connected to the mixed refrigerant outlet 1093 of the ejector 109 with a refrigerant pipe. The refrigeration cycle apparatus 1010 further includes a third refrigerant channel branching off from a halfway point of the refrigerant pipe connecting a refrigerant outlet of the condenser 103 and the first flow control valve 104 and in which a third flow control valve 108 and the motive refrigerant inlet 1091 of the ejector 109 are connected in that order with a pipe.

(Configuration of Ejector 109)

Figure 2:
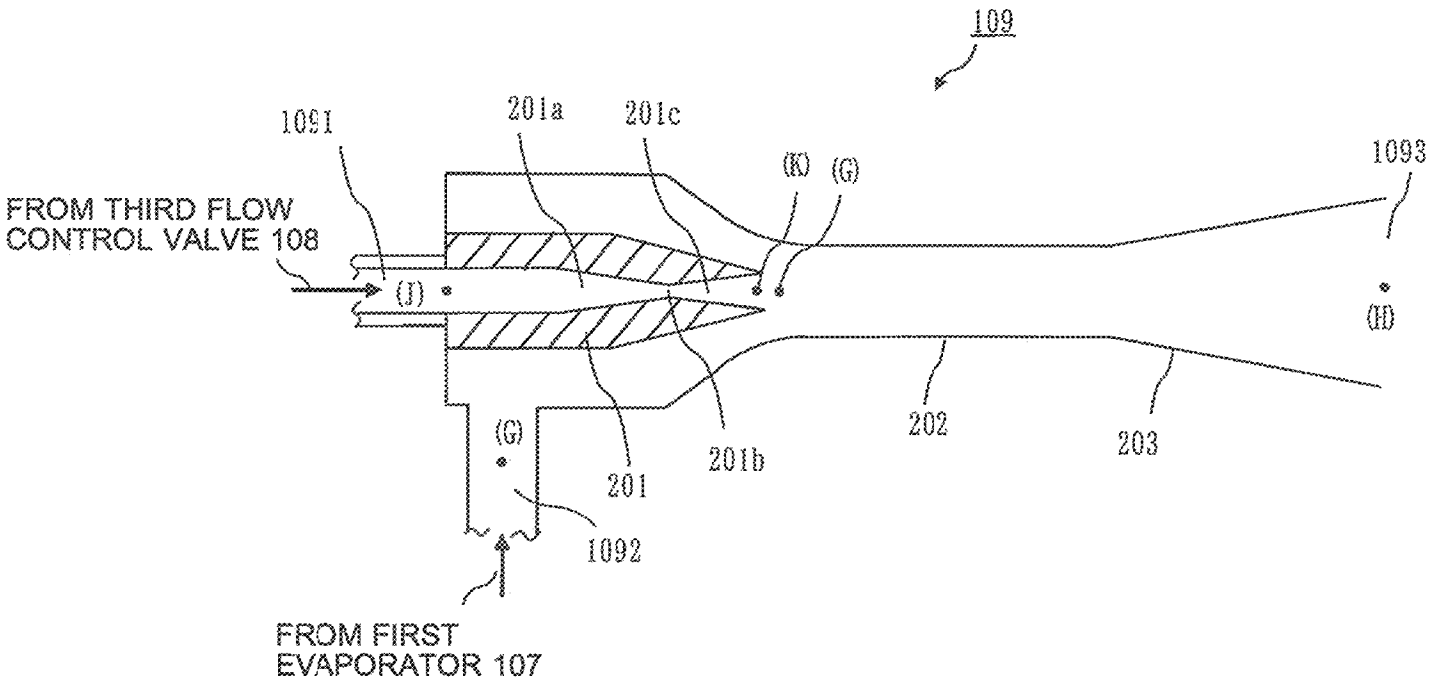
FIG. 2 is a schematic diagram illustrating an internal configuration of an ejector 109 according to Embodiment 1.

FIG. 2 is a diagram illustrating a configuration of the ejector 109. The ejector 109 includes a nozzle 201, a mixing section 202, and a diffuser 203. The nozzle 201 includes a pressure reducing portion 201*a* (a throttle portion), a throat portion 201*b*, and a divergent portion 201*c*. A high-pressure refrigerant (motive refrigerant) flowing out of the condenser 103 flows into the ejector 109 via the motive refrigerant inlet 1091. The motive refrigerant is subjected to pressure reduction and is expanded in the pressure reducing portion 201*a*. The motive refrigerant flows through the throat portion 201*b* at sonic speed into the divergent portion 201*c*, where the speed of the motive refrigerant is increased to an ultrasonic speed and the motive refrigerant is subjected to further pressure reduction. Thus, an ultrahigh-speed two-phase gas-liquid refrigerant flows out of the nozzle 201. Meanwhile, a refrigerant (a suction refrigerant) at the suction refrigerant inlet 1092 is drawn by the ultrahigh-speed refrigerant that has flowed out of the nozzle 201. The ultrahigh-speed motive refrigerant and the low-speed suction refrigerant start to be mixed together at the outlet of the nozzle 201, i.e., at the inlet of the mixing section 202, whereby the momenta of the refrigerants are exchanged with each other. Thus, the pressure is recovered (increased). The diffuser 203 forms a divergent flow path. Therefore, the flow speed is reduced. Thus, the pressure is recovered. Consequently, a mixed refrigerant as a mixture of the motive refrigerant and the suction refrigerant flows out of the mixed refrigerant outlet 1093 of the diffuser 203.

Figure 3:
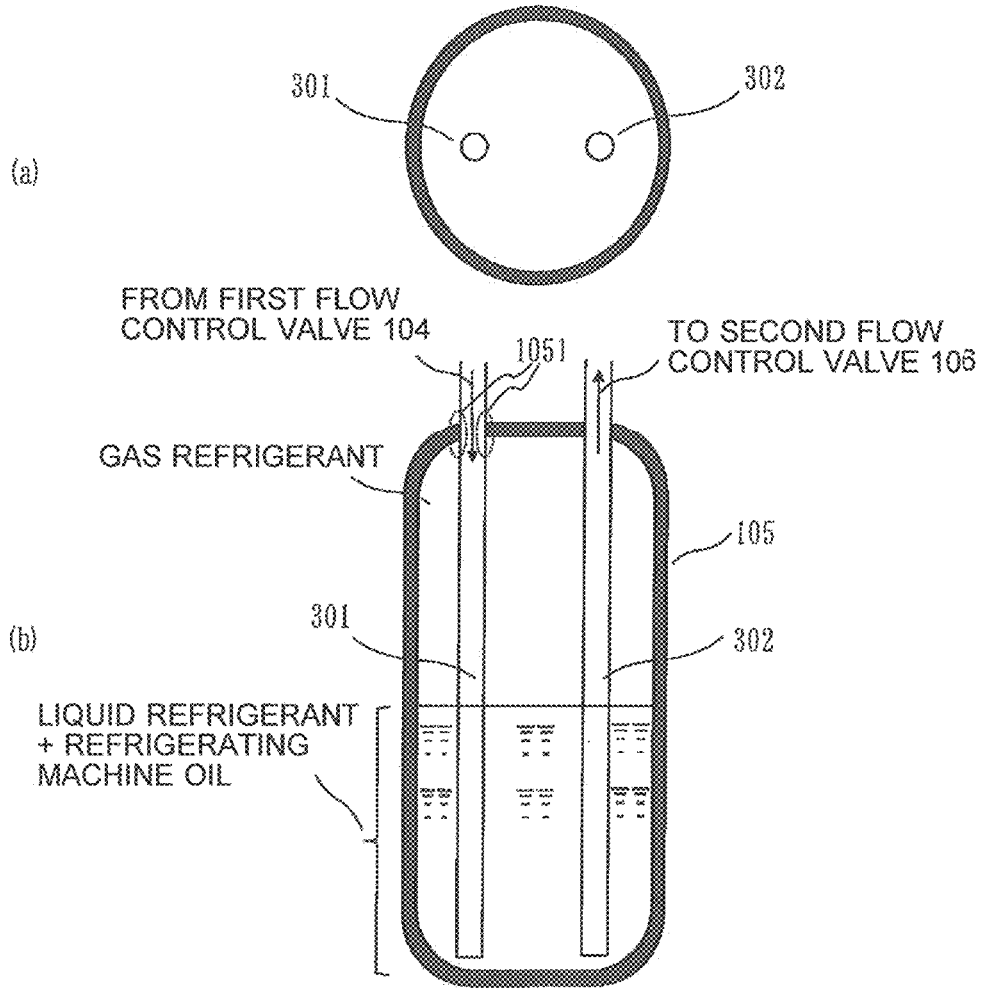
FIG. 3 includes schematic diagrams of a refrigerant storing container 105 according to Embodiment 1.

FIG. 3 includes diagrams illustrating an outline of an internal configuration of the refrigerant storing container 105. FIG. 3(*a*) is a plan view of the refrigerant storing container 105. FIG. 3(*b*) is a vertical sectional view of the refrigerant storing container 105. Two refrigerant pipes 301 and 302 extend through the refrigerant storing container 105 from the upper side to near the bottom of the container. The refrigerant pipe 301 is connected to the first flow control valve 104. The refrigerant pipe 302 is connected to the second flow control valve 106. The refrigerant storing container 105 and the refrigerant pipes 301 and 302 are welded to each other and are fixedly held by each other at connections 1051. Thus, the airtightness of the container is provided.

In such a configuration, the high-pressure liquid refrigerant residing at the bottom of the refrigerant storing container 105 and the refrigerating machine oil dissolved in the refrigerant flow out of the refrigerant pipe 302.

(Configuration of Compressor 101)

Figure 4:
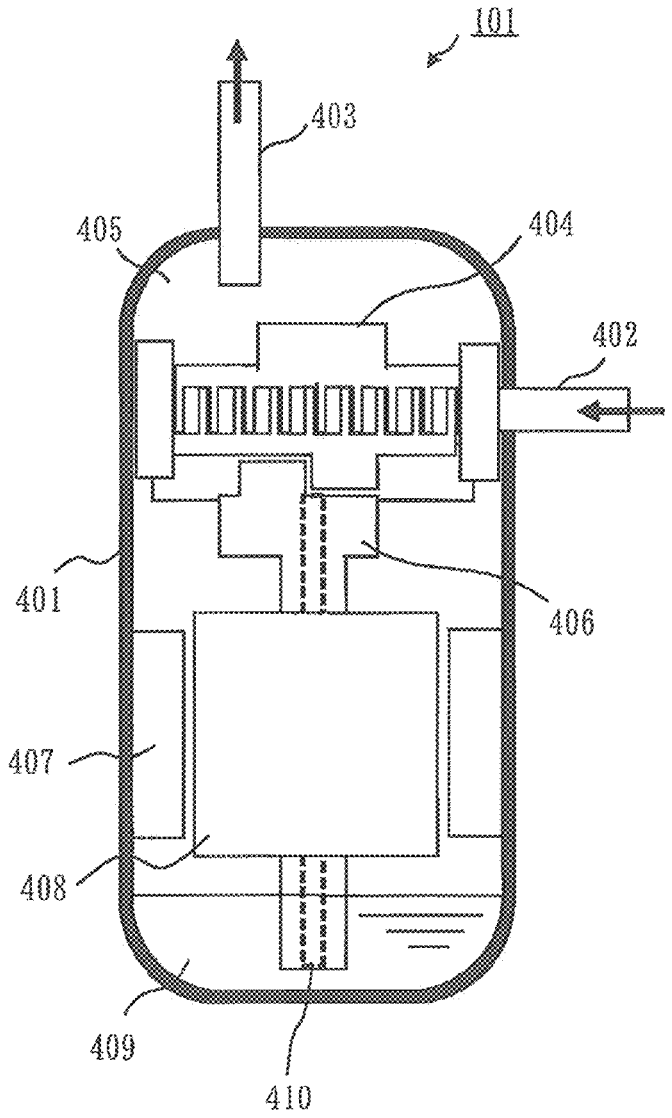
FIG. 4 is a schematic diagram of a compressor 101 according to Embodiment 1.

FIG. 4 is a schematic diagram illustrating an internal configuration of the compressor 101. Referring to FIG. 4, the internal configuration of the compressor 101 will now be described. A shell 401 houses a compressing mechanism and a driving mechanism. The compressor 101 suctions a low-pressure gas refrigerant via a suction pipe 402 and discharges a high-pressure gas refrigerant via a discharge pipe 403. A compressing mechanism 404 illustrated in FIG. 4 as a scroll type. The compressing mechanism 404 is not limited to be of a scroll type and may be of a rotary type or a piston type. The gas refrigerant compressed by the compressing mechanism 404 is temporarily discharged into a shell space 405, whereby the high-pressure gas fills the inside of the shell, while the high-pressure gas flows out of the discharge pipe 403.

The driving mechanism is a motor including a stator 407 and a rotor 408. The rotor 408 is rotatably connected to a shaft 406. This rotational motion is transmitted to the compressing mechanism 404, whereby the refrigerant is compressed. Refrigerator oil 409 resides at the bottom of the shell 401. The difference between the pressure in the high-pressure space 405 and the pressure in a low-pressure space in the compressing mechanism causes the refrigerating machine oil to be supplied to the compressing mechanism 404 via an oil supplying mechanism 410. Some of the refrigerating machine oil supplied to the compressing mechanism 404 accompanies the high-pressure gas refrigerant and flows out of the discharge pipe 403 into the condenser 103. That is, if the oil at the bottom of the shell 401 runs out or decreases, the supply of the oil to the compressing mechanism 404 stagnates. This may lead to failure due to seizing of the shaft with heat.

(Description of Operational Process)

Figure 5:
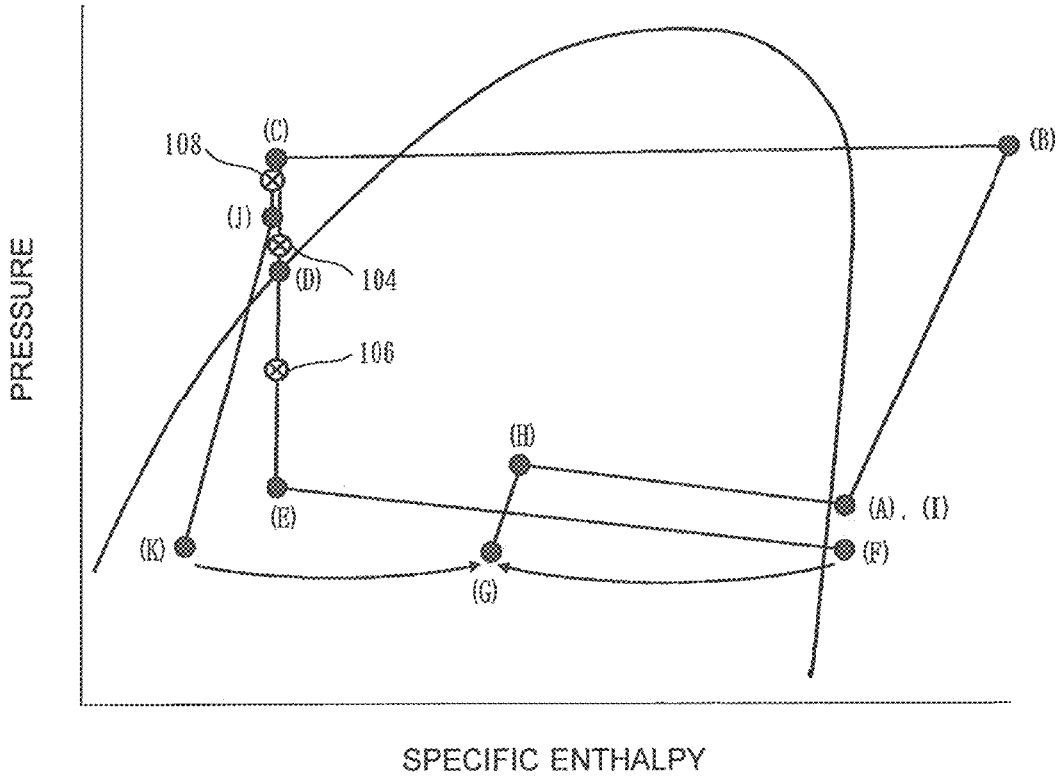
FIG. 5 is a Mollier diagram for the refrigeration cycle apparatus 1010 according to Embodiment 1.

FIG. 5 is a Mollier diagram for the refrigeration cycle apparatus 1010. Referring to the Mollier diagram illustrated in FIG. 5, an operation of a heating operation performed by the refrigeration cycle apparatus 1010 will now be described. In the Mollier diagram illustrated in FIG. 5, the horizontal axis represents the specific enthalpy of the refrigerant, and the vertical axis represents the pressure. Points denoted by A and other reference characters and illustrated as black dots in the diagram represent the state of the refrigerant ((A) and other reference characters illustrated as black dots) in the pipes included in the refrigeration cycle apparatus 1010 illustrated in FIG. 1.

A low-pressure refrigerant in a state A in the suction pipe 402 of the compressor 101 is compressed by the compressing mechanism 404, as described above, and falls into a state B. Then, the refrigerant flows out of the compressor 101 together with the refrigerating machine oil. The refrigerant in the state B flows through a four-way valve 102 into the condenser 103, where heat is exchanged between the refrigerant and indoor air. Thus, the refrigerant is cooled and falls into a state C. The refrigerant in the state C diverges into a refrigerant flowing into the motive refrigerant inlet 1091 of the ejector 109 and a refrigerant flowing into the first flow control valve 104. The refrigerant subjected to pressure reduction at the first flow control valve 104 and fallen into a state D flows into the refrigerant storing container 105. In the refrigerant storing container 105, liquid refrigerant, which has a higher density, resides at the bottom of the container while gas refrigerant resides on the upper side of the container. The refrigerant flowing out of the refrigerant storing container 105 is in a state of a saturated liquid refrigerant. Refrigerator oil dissolved in the liquid refrigerant flows out of the refrigerant storing container 105 together with the liquid refrigerant. The liquid refrigerant and the refrigerating machine oil having flowed out of the refrigerant storing container 105 are subjected to pressure reduction at the second flow control valve 106 and fall into a state E. Then, the liquid refrigerant and the refrigerating machine oil flow into the first evaporator 107, where the refrigerant is heated by exchanging heat with outside air.

Meanwhile, the refrigerant in the state C having diverged from the condenser 103 and flowed into the third flow control valve 108 is subjected to pressure reduction and falls into a state J. Then, the refrigerant flows into the ejector 109. An ultrahigh-speed fluid in a state K obtained through pressure reduction in the nozzle 201 of the ejector is mixed with a suction refrigerant, i.e., a refrigerant in a state F having flowed out of the first evaporator 107, immediately after flowing out of the outlet of the nozzle 201, whereby a mixture in a state G is obtained. The mixture is subjected to pressure increase while flowing through the mixing section 202 and the diffuser 203 and falls into a state H. Then, the mixture flows out of the ejector 109.

The refrigerant in the state H exchanges heat with outside air in the second evaporator 110 and falls into a state I. Then, the refrigerant flows through the suction pipe 402 of the compressor into the compression mechanism. The refrigerating machine oil separated from the refrigerant returns to the bottom of the shell 501. Through the above operation, a refrigeration cycle is established.

(Case of Defrosting Operation)

A case of a defrosting operation performed by the refrigeration cycle apparatus 1010 will now be described. In the heating operation, the outdoor heat exchangers (the first evaporator 107 and the second evaporator 110) function as evaporators. Therefore, the saturation temperature of the refrigerant flowing through the outdoor heat exchangers is lower than that of the outside air. If the evaporating temperature falls below 0° C., water vapor in the atmosphere turns into frost and adheres to the outdoor heat exchangers.

If any frost adheres to the outdoor heat exchangers, the thermal resistance increases and the evaporation capacity is reduced. Therefore, a defrosting operation needs to be performed regularly. In the defrosting operation, the four-way valve 102 is switched and the third flow control valve 108 is fully opened. In the defrosting operation, the radiator in the heating operation functions as a heat receiver, and the heat receiver in the heating operation functions as a radiator.

When the defrosting operation is started, the flow path of the four-way valve 102 is switched such that a high-temperature, high-pressure refrigerant sent out from the compressor 101 flows into the second evaporator 110 (an outdoor heat exchanger), where the high-temperature, high-pressure refrigerant melts the frost adhered to the outdoor heat exchanger (the second evaporator 110). In this case, the second evaporator 110 functions as a condenser. Subsequently, the refrigerant flows through the diffuser 203, the mixing section 202, and the suction refrigerant inlet 1092 of the ejector 109 into the first evaporator 107 (an outdoor heat exchanger), where the refrigerant melts the frost adhered to the first evaporator 107. The refrigerant further flows through the second flow control valve 106, the refrigerant storing container 105, and the first flow control valve 104, and then flows into the condenser 103 (an indoor heat exchanger) as a low pressure refrigerant, where the refrigerant is heated by indoor air. Subsequently, the refrigerant flows through the four-way valve 102 and returns to the suction pipe 402 of the compressor 101.

(Cooling Operation)

A cooling operation is achieved through the same operation as that of the defrosting operation.

As described above, in the refrigeration cycle apparatus 1010 according to Embodiment 1, excessive refrigerant is stored in the refrigerant storing container 105 at a position where the refrigerant has an intermediate pressure, and the liquid refrigerant is made to flow out of the refrigerant storing container 105. Therefore, the refrigerating machine oil dissolved in the refrigerant is easily brought out together with the refrigerant and is made to circulate. Hence, the refrigerating machine oil reliably returns to the compressor 101. Accordingly, seizing of the compressor 101 with heat due to running out of the oil is prevented, and a highly reliable refrigeration cycle apparatus 1010 is obtained. Thus, in the refrigeration cycle apparatus 1010, the refrigerating machine oil is reliably returned to the compressor 101 with a simple configuration employing the ejector 109.

While Embodiment 1 concerns a case where the refrigerant is R410A and the refrigerating machine oil is oil that is miscible with the refrigerant, such as ether oil, the present invention is not limited to such a case.

(Case of Non-Compatible Refrigerator Oil)

Figure 6:
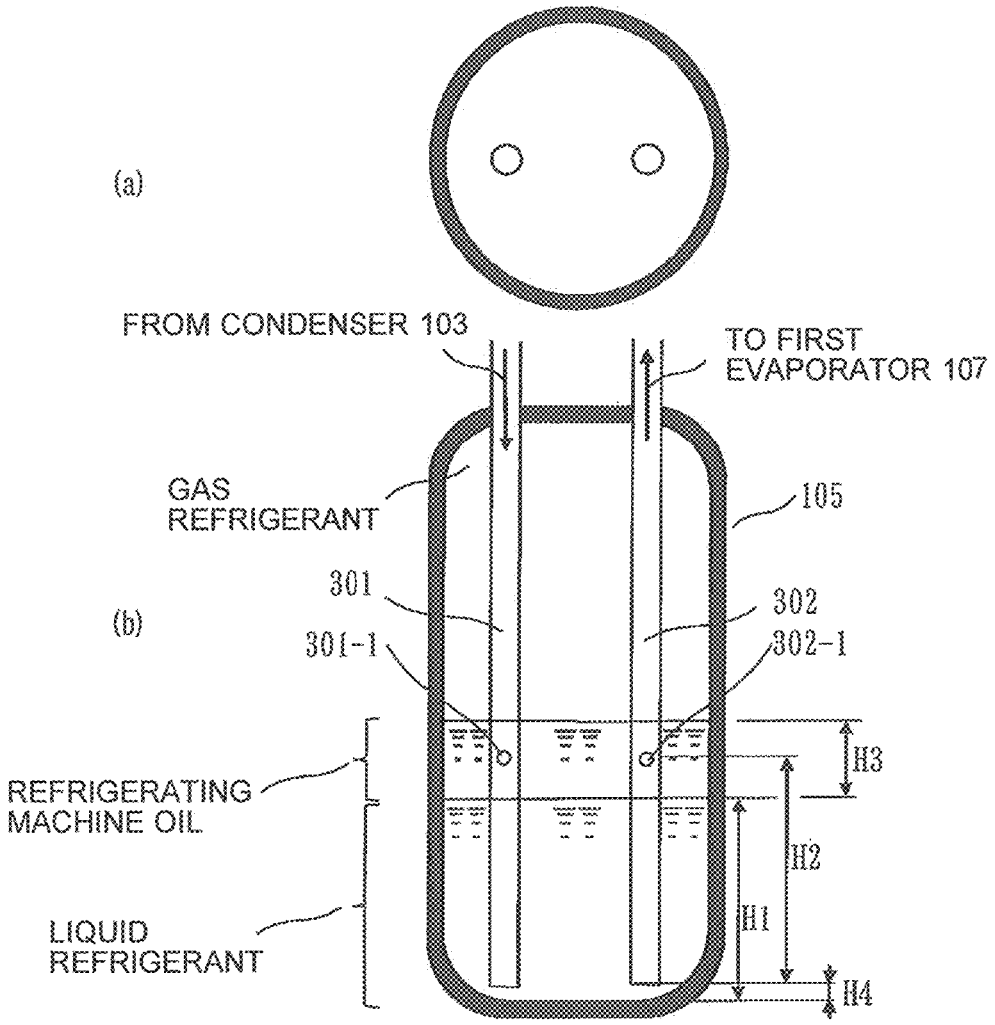
FIG. 6 includes schematic diagrams of the refrigerant storing container 105 according to Embodiment 1.

FIG. 6 illustrates a configuration of the refrigerant storing container 105 in a case where immiscible refrigerating machine oil having a lower density than the liquid refrigerant is employed. FIG. 6(*a*) is a plan view of the refrigerant storing container 105. FIG. 6(*b*) is a vertical sectional view of the refrigerant storing container 105. In this case, a layer of refrigerating machine oil resides above the liquid refrigerant. Therefore, with the refrigerant pipes 301 and 302 configured as illustrated in FIG. 3, only the liquid refrigerant flows out, and the refrigerating machine oil does not return to the compressor 101. Hence, oil return holes 301-1 and 302-1 are provided in the peripheral surfaces of the respective refrigerant pipes 301 and 302 at positions where the layer of oil resides, whereby the refrigerating machine oil is made to circulate together with the refrigerant. The refrigerant pipes 301 and 302 are both provided with the oil return holes out of consideration of a reverse cycle. The oil return hole 302-1 is provided at a position defined by a dimension H2 measured from the opening of the refrigerant pipe 302 on the bottom side of the container. The dimension H2 is determined by a distance H4 between the bottom of the container and the opening, a height H1 to the surface of the liquid refrigerant stored, a thickness H3 of the layer of refrigerating machine oil, and so forth. The foregoing factors are determined by the shape of the refrigerant storing container 105, the performance of the refrigeration cycle apparatus 1010, and so forth. The oil return hole 302-1 may be provided in any number. Only one oil return hole 302-1 may be provided, as long as the refrigerating machine oil can reliably to flow therethrough. If the diameter of the oil return hole 302-1 is too large, only the refrigerating machine oil flows out and the performance of the evaporator is deteriorated. Therefore, the diameter of the oil return hole 302-1 is determined on the basis of the position of the oil return hole, the viscosity of the refrigerating machine oil, and so forth. The same applies to the oil return hole 301-1.

Figure 7:
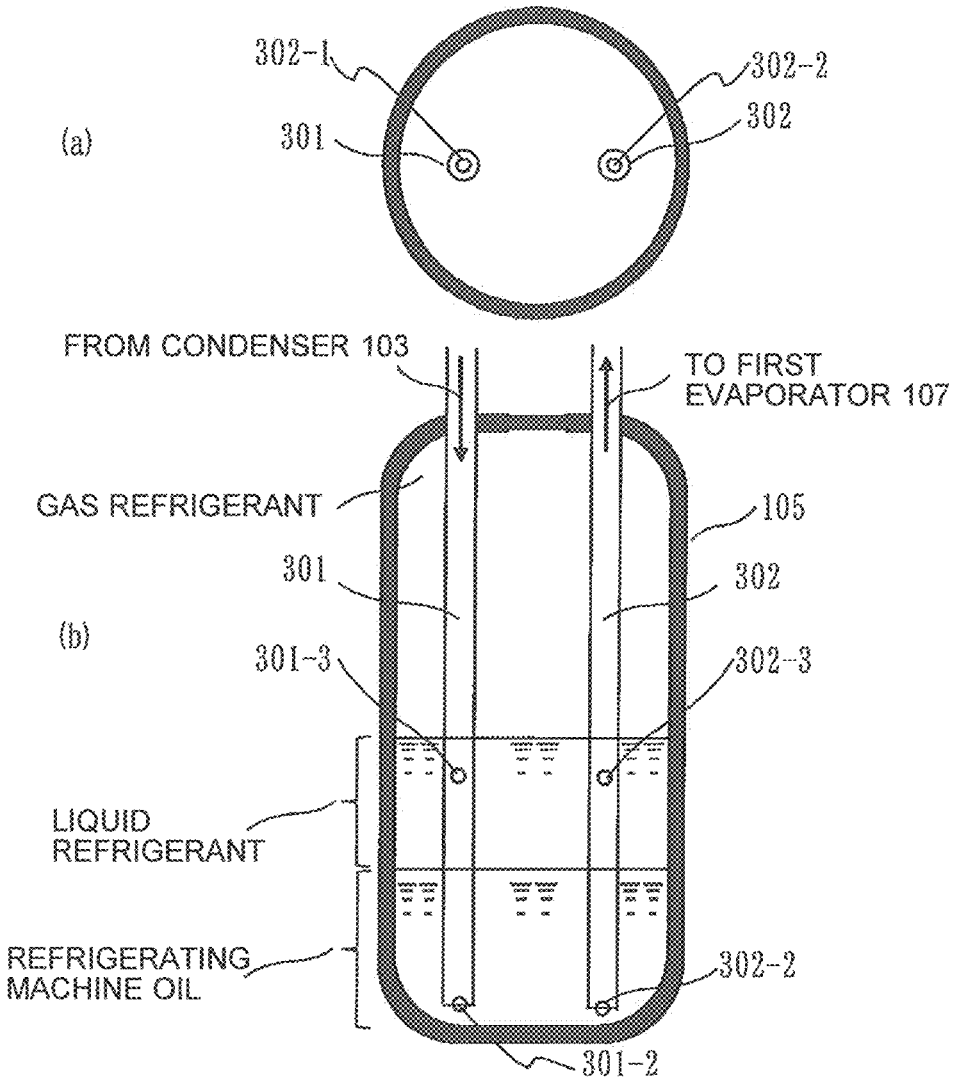
FIG. 7 includes schematic diagrams of the refrigerant storing container 105 according to Embodiment 1.

FIG. 7 illustrates a configuration of the refrigerant storing container 105 in a case where immiscible refrigerating machine oil having a higher density than the liquid refrigerant is employed. FIG. 7(*a*) is a plan view of the refrigerant storing container 105. FIG. 7(*b*) is a vertical sectional view of the refrigerant storing container 105. In this case, the refrigerating machine oil deposits below the liquid refrigerant. In such a case, only the refrigerating machine oil flows out via the opening of the refrigerant pipe 302, and the performance of the evaporator is deteriorated. Hence, the opening of the refrigerant pipe 302 is sealed, and an oil return hole 302-2 is provided at the sealed portion. Furthermore, a refrigerant outlet 302-3 is provided in the refrigerant pipe 302 at a position where the layer of liquid refrigerant resides, similarly to the oil return hole 302-1 illustrated in FIG. 6. The oil return hole 302-2 and the refrigerant outlet 302-3 allow the refrigerating machine oil and the liquid refrigerant to flow out of the refrigerant storing container 105. FIG. 7 illustrates an exemplary case where one refrigerant outlet 302-3 is provided for the refrigerant pipe 302. Alternatively, a plurality of refrigerant outlets 302-3 may be provided in line in the vertical direction so that the liquid refrigerant can reliably flow out even if the liquid surface goes down. The above description also applies to the refrigerant pipe 301 in the case of the reverse cycle.

The refrigerant employed in the refrigeration cycle apparatus 1010 according to Embodiment 1 is not limited to a fluorocarbon refrigerant, such as R410A, and may be propane, isobutane (a hydrocarbon refrigerant), or carbon dioxide. Even with propane or $CO_2$, the advantages in Embodiment 1 are obtained. In a case where propane, which is a flammable refrigerant, is employed, the evaporator and the condenser that are housed in one casing may be installed at an isolated position. Furthermore, hot water or cold water generated by circulating water through the condenser or the evaporator of the refrigeration cycle apparatus 1010 may be made to circulate in the indoor side. Thus, the refrigeration cycle apparatus 1010 can be used as a safe air-conditioning apparatus. The same advantages are also obtained in a case where an HFO (hydrofluoro-olefin) refrigerant, which is a low-GWP refrigerant or a mixed refrigerant containing the same is employed.

Figure 8:
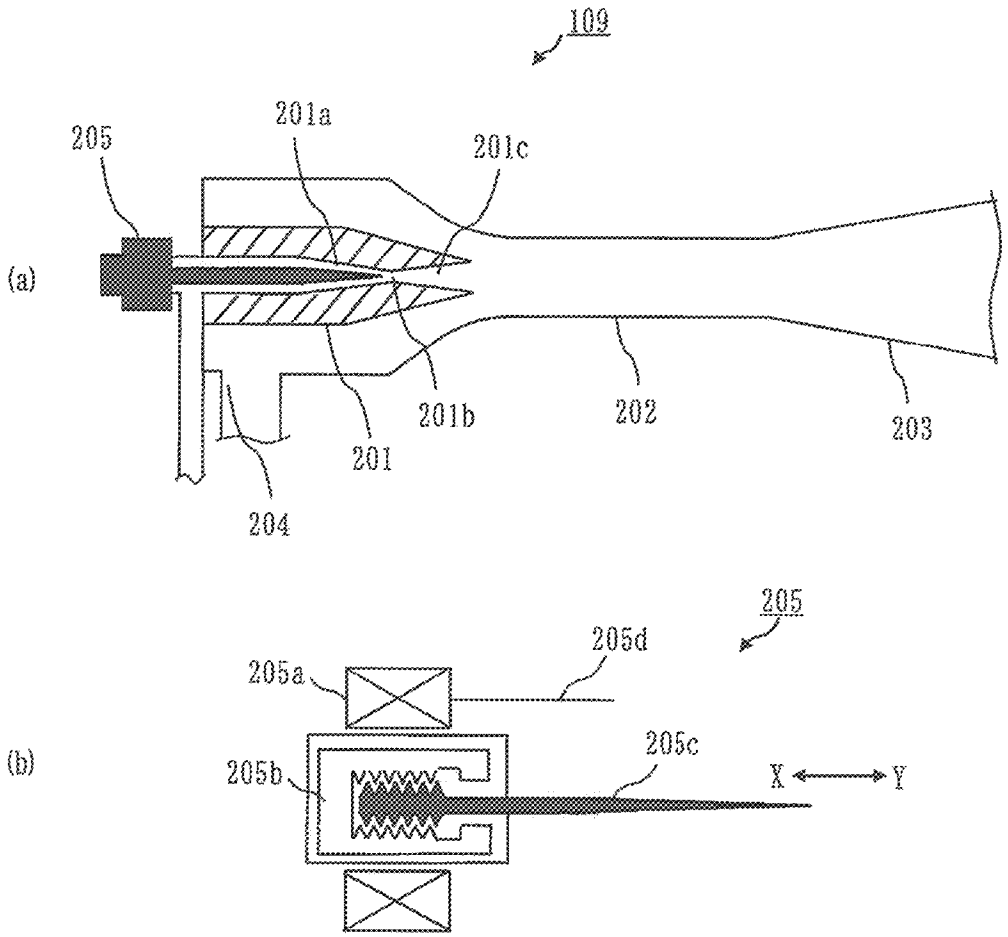
FIG. 8 includes diagrams illustrating an ejector provided with a needle valve according to Embodiment 1.

FIG. 8 includes diagrams illustrating an ejector 109 integrally provided with a needle valve 205. FIG. 1 illustrates a configuration in which the third flow control valve 108 is provided on the upstream side of the ejector 109. Alternatively, an ejector including the ejector 109 and the needle valve 205, which is movable, provided as an integral body as illustrated in FIG. 8 may be employed.

FIG. 8(*a*) is a general view of the ejector provided with the needle valve. FIG. 8(*b*) illustrates a configuration of the needle valve 205. The needle valve 205 includes a coil 205*a*, a rotor 205*b*, and a needle 205*c*. When the coil 205*a* receives a pulse signal from a non-illustrated control-signal-transmitting unit via a signal cable 205*d*, the coil 205*a* produces magnetic poles. Then, the rotor 205*b* provided on the inner side of the coil rotates. The rotating shaft of the rotor 205*b* has a screw and a needle processed therein. The rotation of the screw is converted into a motion in the axial direction, whereby the needle 205*c* moves. The needle 205*c* is configured to move in the lateral direction (XY direction) in the drawing so that the flow rate of the motive refrigerant flowing from the condenser 103 is adjustable. In such a configuration, the third flow control valve 108 is substituted for by the movable needle valve 205. That is, the ejector 109 and the third flow control valve 108 can be combined together. Hence, the pipe connecting the two can be omitted. Consequently, cost is reduced.

Moreover, the first flow control valve 104 and the second flow control valve 106 may be configured to adjust the flow rate by utilizing capillaries for the purpose of cost reduction.

Embodiment 2

Figure 9:
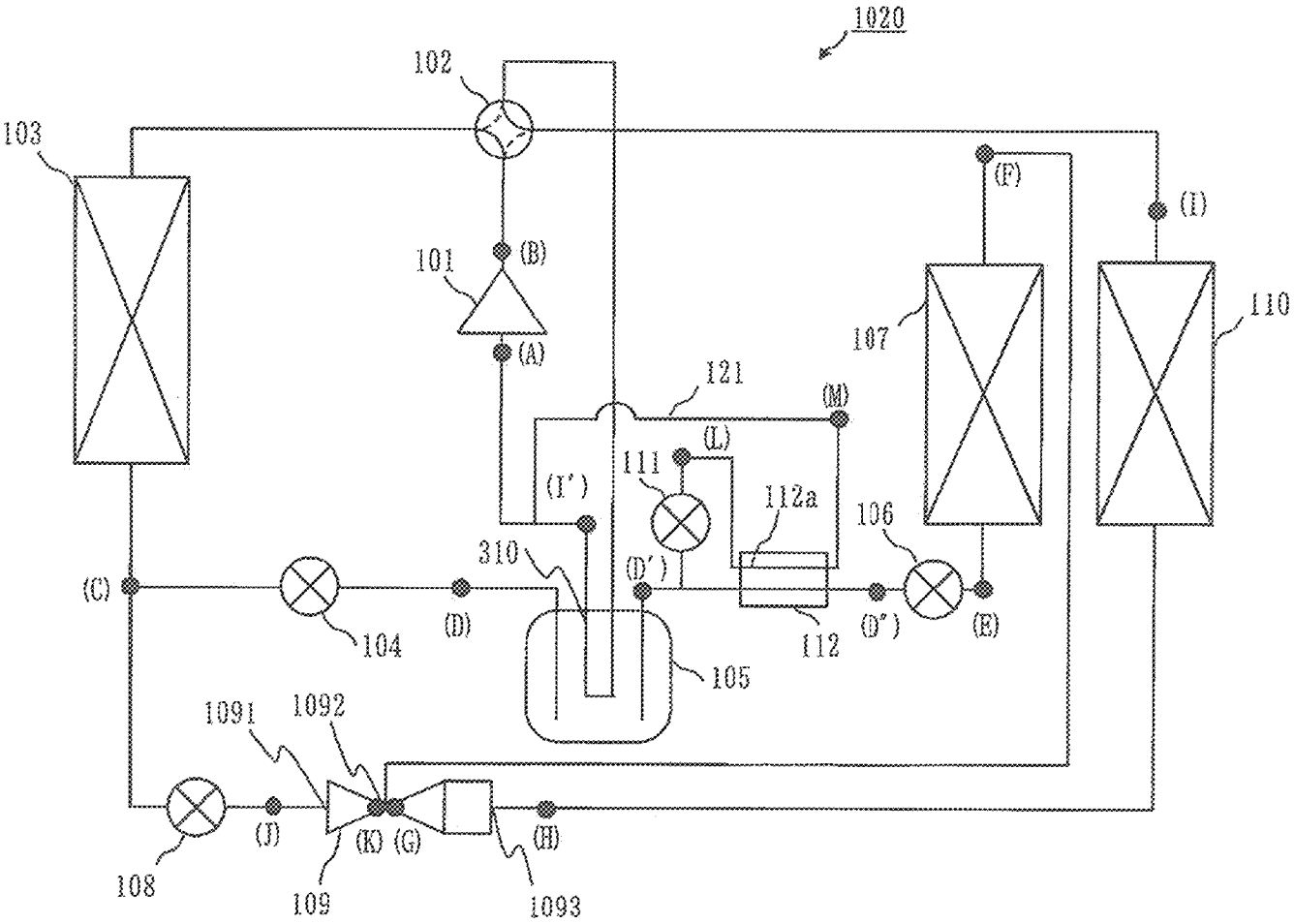
FIG. 9 is a refrigerant circuit diagram of a refrigeration cycle apparatus 1020 according to Embodiment 2.
Figure 10:
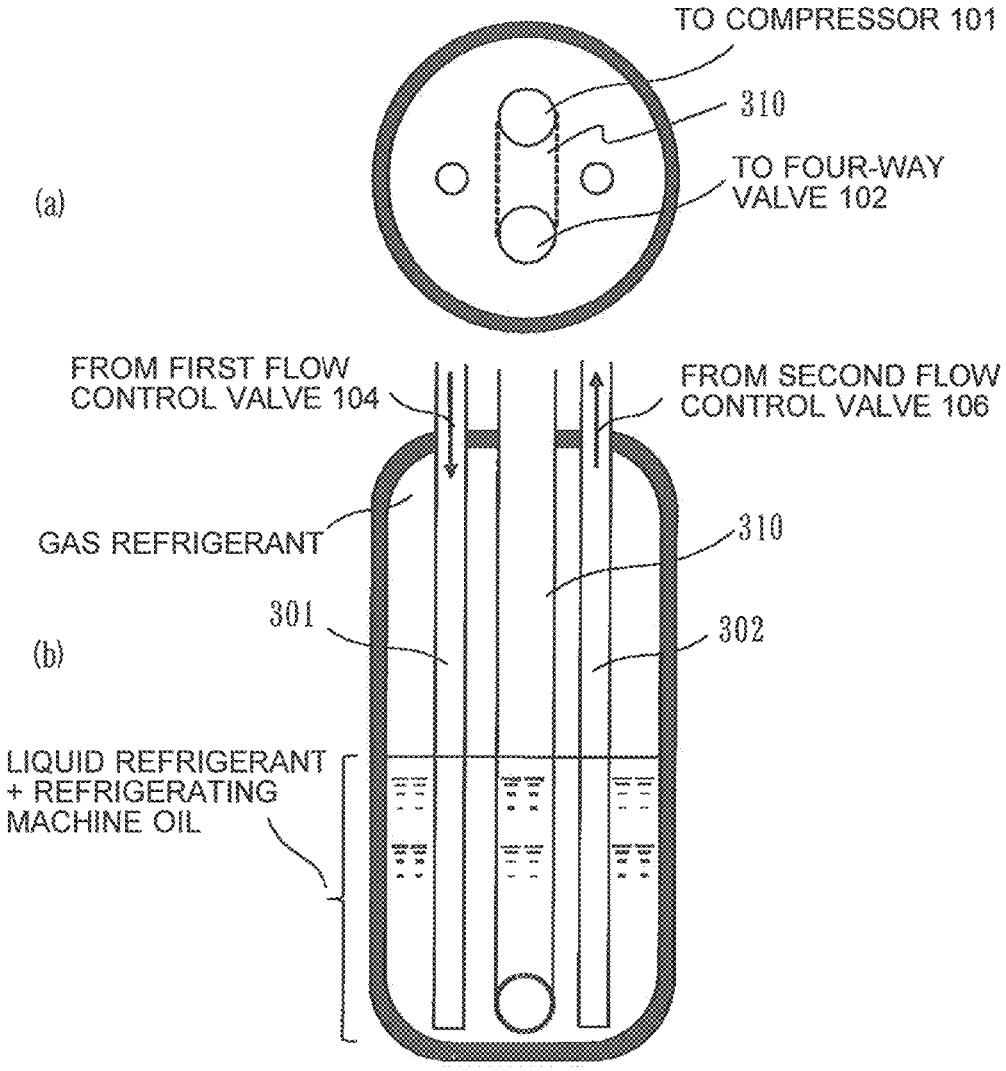
FIG. 10 includes schematic diagrams of a refrigerant storing container 105 according to Embodiment 2.
Figure 11:
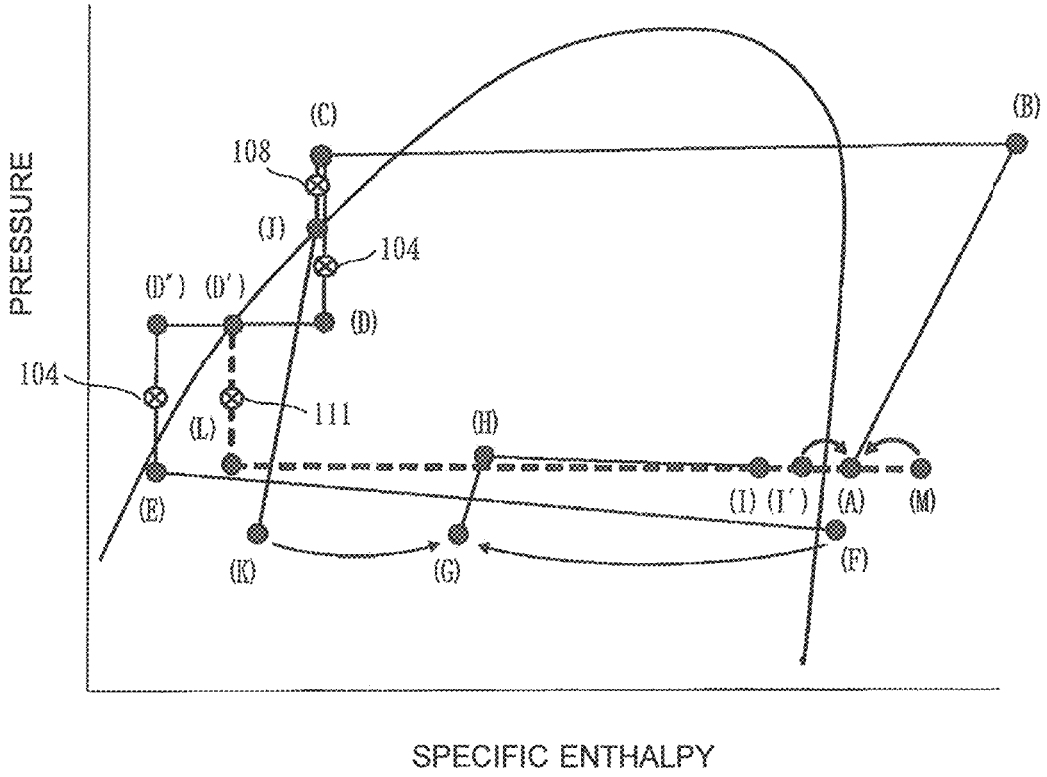
FIG. 11 is a Mollier diagram for the refrigeration cycle apparatus 1020 according to Embodiment 2.

Referring to FIGS. 9 to 11, Embodiment 2 will now be described.

FIG. 9 illustrates a refrigeration cycle apparatus 1020 according to Embodiment 2.

FIG. 10 illustrates a configuration of a refrigerant storing container 105 according to Embodiment 2. FIG. 10(*a*) is a plan view of the refrigerant storing container 105. FIG. 10(*b*) is a vertical sectional view of the refrigerant storing container 105. In Embodiment 2, a refrigerant pipe 310 connecting the second evaporator 110, the four-way valve 102, and the suction port 402 of the compressor 101 extends through the refrigerant storing container 105. In FIG. 1 illustrating Embodiment 1 also, the refrigerant pipe 310 may be provided in such a manner as to extend through the refrigerant storing container 105, as in the configuration illustrated in FIG. 9.

An internal heat exchanger 112 is connected between the refrigerant storing container 105 and the second flow control valve 106. The refrigeration cycle apparatus 1020 includes a bypass 121 branching off from a halfway point of a refrigerant pipe connecting the internal heat exchanger 112 and the refrigerant storing container 105. In the bypass 121, a fourth flow control valve 111, a low-pressure-side flow path 112*a* of the internal heat exchanger 112, and the suction port of the compressor 101 are connected in that order with pipes.

The refrigerant pipe 310 connecting the second evaporator 110 and the compressor 101 extends through the refrigerant storing container 105. Therefore, the refrigerant residing in the refrigerant storing container 105 and the refrigerant flowing through the refrigerant pipe 310 exchange heat therebetween. This heat exchange reduces the enthalpy of the refrigerant in the refrigerant storing container 105 but increases the enthalpy of the refrigerant suctioned into the compressor 101.

FIG. 11 is a Mollier diagram for the refrigeration cycle apparatus 1020 according to Embodiment 2. Reference character A and others in the drawing represent the state of the refrigerant in the refrigerant pipes illustrated in FIG. 9. A refrigerant in a state C having flowed out of the condenser 103 is subjected to pressure reduction at the first flow control valve 104 and then flows into the refrigerant storing container 105. The refrigerant exchanges heat with a low-pressure, low-temperature refrigerant in the refrigerant storing container 105 and falls into a state D'. The refrigerant as a saturated liquid refrigerant in the state D' having flowed out of the refrigerant storing container 105 is divided into a refrigerant flowing into the bypass 121 and a main refrigerant flowing into the first evaporator 107. The refrigerant flowing into the bypass 121 is subjected to pressure reduction at the fourth flow control valve 111 and falls into a state L. Then, the refrigerant flows into the internal heat exchanger 112, where the refrigerant is heated by the main refrigerant having a high pressure and falls into a state M. The refrigerant in the state M is mixed with a refrigerant in a state I' having flowed out of the refrigerant pipe 310 in the refrigerant storing container 105 and falls into a state A. Then, the mixture is suctioned into the compressor 101.

The bypass 121 reduces the flow rate of the refrigerant flowing into the first evaporator 107. Therefore, the pressure loss occurring in the first evaporator 107 is reduced, and the pressure at the suction refrigerant inlet 1092 (a suctioning portion of the ejector) increases. Consequently, the suction pressure of the compressor can be further increased. The refrigerant is turned into a supercooled liquid in the internal heat exchanger 112. Furthermore, the reduction in the flow rate of the refrigerant is compensated for by an increase in the latent heat of evaporation. Thus, a certain level of evaporation capacity the same as that in a case where no bypass for the refrigerant is provided is maintained.

The refrigerant flowing through the bypass 121 contains the refrigerant oil as the main refrigerant does. Therefore, the refrigerating machine oil reliably returns to the compressor. Thus, running out of the oil is prevented.

Embodiment 3

Figure 12:
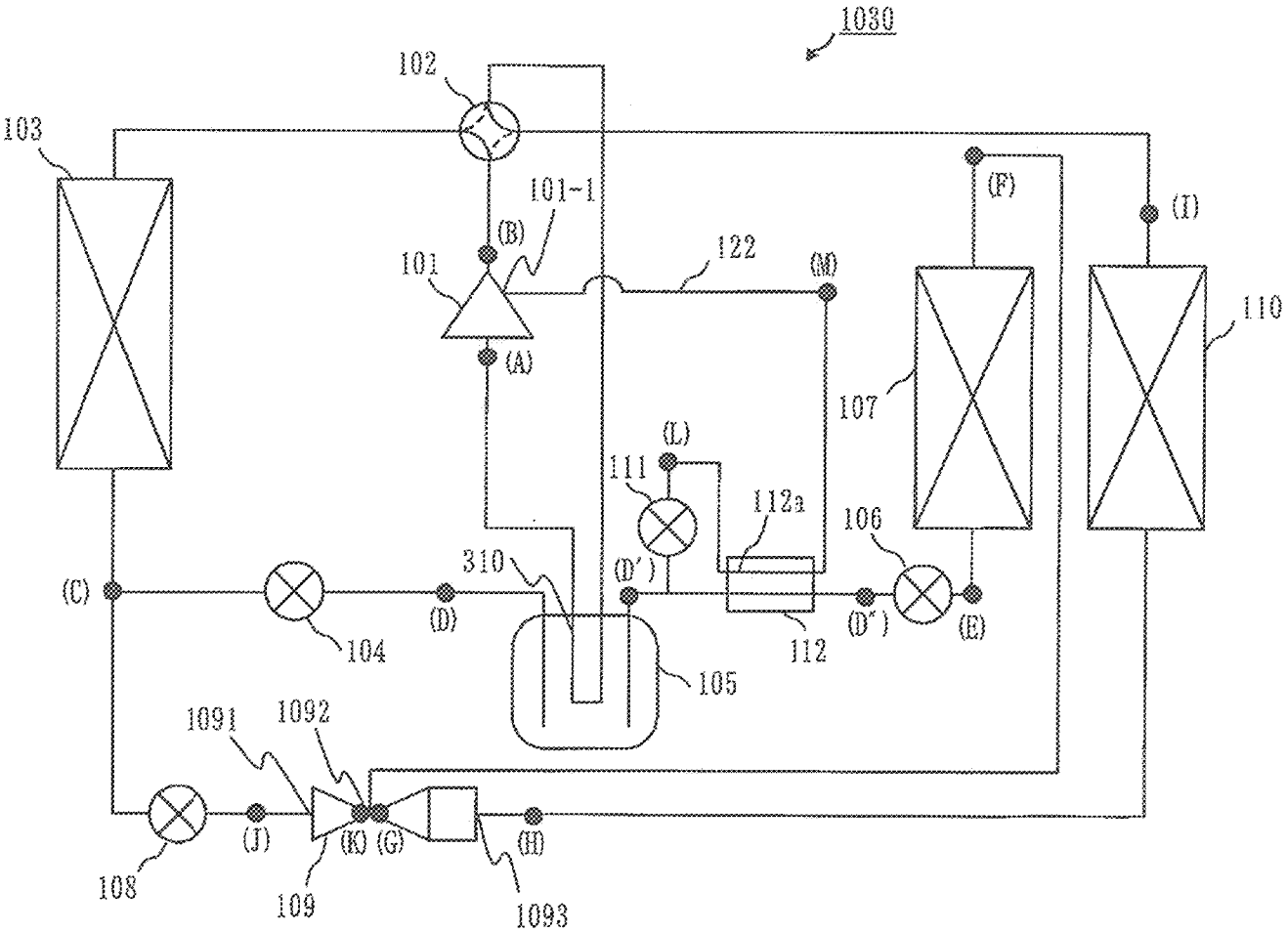
FIG. 12 is a refrigerant circuit diagram of a refrigeration cycle apparatus 1030 according to Embodiment 3.
Figure 13:
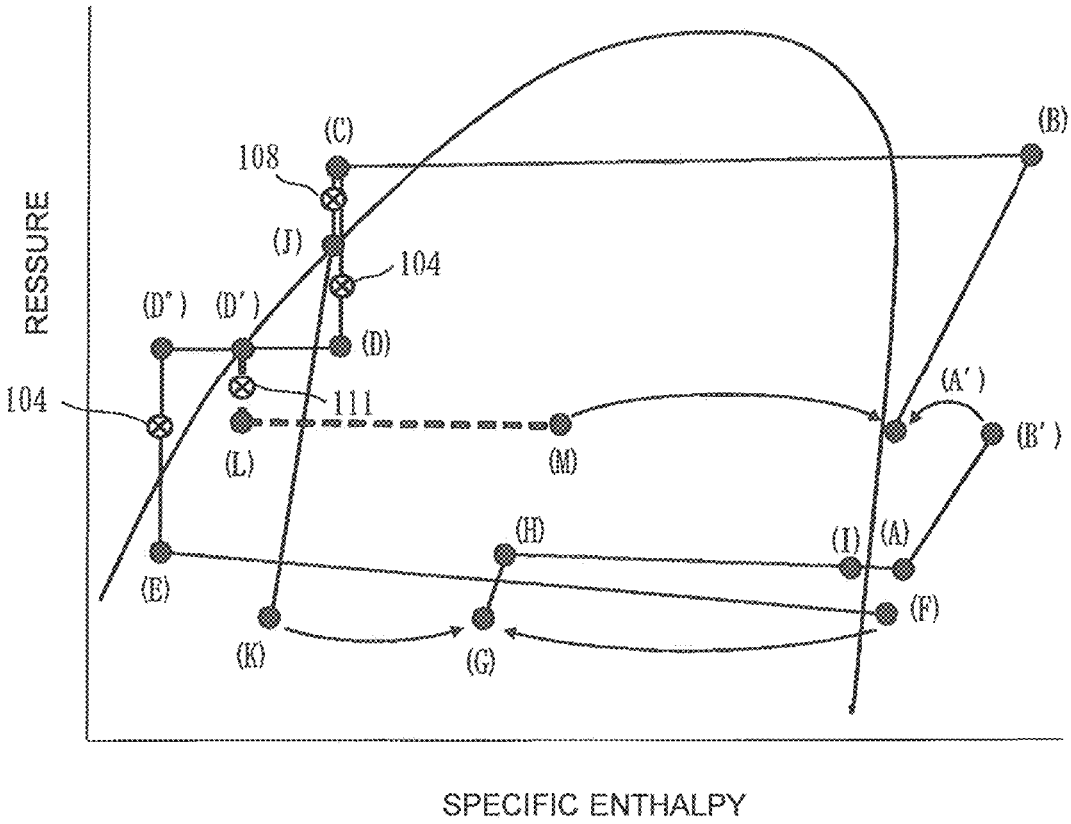
FIG. 13 is a Mollier diagram for the refrigeration cycle apparatus 1030 according to Embodiment 3.

Referring to FIGS. 12 and 13, a refrigeration cycle apparatus 1030 according to Embodiment 3 will now be described. In Embodiment 3, running out of the refrigerating machine oil is prevented. In addition, in an environment where the suction density of the compressor 101 is reduced because of low outside temperature and the heating capacity is therefore reduced, the heating capacity is increased by utilizing a compressor having an injection port.

FIG. 12 is a refrigerant circuit diagram of the refrigeration cycle apparatus 1030 according to Embodiment 3. The bypass 121 of the refrigeration cycle apparatus 1020 according to Embodiment 2 is connected to the suction pipe of the compressor 101. The refrigeration cycle apparatus 1030 according to Embodiment 3 differs in that a bypass 122 is connected to an injection port 101-1 of the compressor 101.

In Embodiment 3, the internal heat exchanger 112 is connected between the refrigerant storing container 105 and the second flow control valve 106. The refrigerant pipe connecting the internal heat exchanger 112 and the refrigerant storing container 105 branches into a pipe that connects the fourth flow control valve 111, the low-pressure-side flow path 112*a* of the internal heat exchanger, and an intermediate pressure portion 101-1 of the compressor 101 having the injection port in that order. The compressor 101 having the injection port may be a two-stage compressor provided as an integral body or may include two compressors connected in series.

FIG. 13 is a Mollier diagram for the refrigeration cycle apparatus 1030 according to Embodiment 3. Reference character A and others in the drawing represent the state of the refrigerant in the refrigerant pipes illustrated in FIG. 10. A liquid refrigerant (in a state E) having flowed out of the refrigerant storing container 105 is divided into a refrigerant flowing into the bypass 122 and a main refrigerant flowing into the first evaporator 107. The refrigerant flowing into the bypass 122 is subjected to pressure reduction at the fourth flow control valve 111 and falls into a state L. Then, the refrigerant flows into the internal heat exchanger 112, where the refrigerant is heated by the main refrigerant having a high pressure and falls into a state M. The refrigerant in the state M is mixed with a refrigerant that has been subjected to pressure increase to an intermediate pressure in the compressor 101 and has fallen into a state B', whereby a mixture in a state A' is obtained. The mixture is then compressed again.

Since the refrigerant on the bypass side is injected into the intermediate pressure portion of the compressor, the amount of refrigerant circulating through the condenser 103 increases. Consequently, the heating capacity is increased.

The refrigerant flowing through the bypass 122 contains the refrigerant oil as the main refrigerant does. Therefore, the refrigerating machine oil reliably returns to the compressor. Thus, running out of the oil is prevented.

The refrigeration cycle apparatuses according to Embodiments 1 to 3 described above are not limited to air-conditioning apparatuses and may each be a water heater including an air heat source utilizing a water-heat exchanger as a condenser, a chiller or a brine cooler including an air heat source utilizing a water-heat exchanger as an evaporator, or a heat-pump chiller utilizing water-heat exchangers as an evaporator and a condenser.

The refrigeration cycle apparatuses according to Embodiments 1 to 3 described above each employ an ejector and can each avoid failure caused by seizing with heat due to running out of the refrigerating machine oil in the compressor. Therefore, a highly reliable refrigeration cycle apparatus is provided. Moreover, since no oil returning mechanisms are necessary, a low-cost refrigeration cycle apparatus is provided.

Embodiments 1 to 3 above each concern a case where devices, such as a compressor, a flow control valve, and a four-way valve, are controlled to operate. Such devices are controlled by non-illustrated controllers (or control units).

While Embodiments 1 to 3 above each concern a refrigeration cycle apparatus, the refrigeration cycle apparatus may be regarded as a refrigerant circulation method given below.

Specifically, a refrigerant circulation method in which refrigerants are made to circulate by using an ejector including a motive refrigerant inlet into which a motive refrigerant flows, a suction refrigerant inlet into which a suction refrigerant flows, and a mixed refrigerant outlet out of which a mixed refrigerant as a mixture of the motive refrigerant and the suction refrigerant flows, the refrigerant circulation method comprising:

forming a first refrigerant channel in which a compressor, a radiator, a first flow control valve, a refrigerant storing container, a second flow control valve, and a first evaporator are connected in that order with pipes and in which a refrigerant outlet of the first evaporator is connected to the suction refrigerant inlet of the ejector with a pipe;

forming a second refrigerant channel in which the compressor and a second evaporator are connected in that order with a pipe and in which a refrigerant inlet of the second evaporator is connected to the mixed refrigerant outlet of the ejector with a pipe; and forming a third refrigerant channel branching off from a halfway point of the pipe connecting a refrigerant outlet of the radiator and the first flow control valve and in which a third flow control valve and the motive refrigerant inlet of the ejector are connected in that order with a pipe.

REFERENCE SIGNS LIST

101 compressor; 102 four-way valve; 103 condenser; 104 first flow control valve; 105 refrigerant storing container; 106 second flow control valve; 107 first evaporator; 108 third flow control valve; 109 ejector; 1091 motive refrigerant inlet; 1092 suction refrigerant inlet; 1093 mixed refrigerant outlet; 110 second evaporator; 111 fourth flow control valve; 12 internal heat exchanger; 121, 122 bypass; 201 nozzle; 201*a* pressure reducing portion; 201*b* throat portion; 201*c* divergent portion; 202 mixing section; 203 diffuser; 204 suction portion; 205 needle valve; 205*a* coil; 205*b* rotor; 205*c* needle; 205*d* signal cable; 301, 302, 310 refrigerant pipe; 301-1, 302-1, 301-2, 302-2 oil return hole; 301-3, 302-3 refrigerant outlet; 1010, 1020, 1030 refrigeration cycle apparatus.

The invention claimed is:

1. A refrigeration cycle apparatus that is provided with an ejector having a motive refrigerant inlet into which a motive refrigerant flows, a suction refrigerant inlet into which a suction refrigerant flows, and a mixed refrigerant outlet out of which a mixed refrigerant as a mixture of the motive refrigerant and the suction refrigerant flows, and that circulates a refrigerant therethrough, the refrigeration cycle apparatus comprising:

a first refrigerant channel having a compressor, a radiator, a first flow control valve, a refrigerant storing container, a second flow control valve, and a first evaporator connected in that order with pipes, the first refrigerant channel having a refrigerant outlet of the first evaporator connected to the suction refrigerant inlet of the ejector with a pipe;

a second refrigerant channel having the compressor and a second evaporator connected in that order with a pipe, the second refrigerant channel having a refrigerant inlet of the second evaporator connected to the mixed refrigerant outlet of the ejector with a pipe; and a third refrigerant channel being branched off from a halfway point of the pipe connecting a refrigerant outlet of the radiator and the first flow control valve, the third refrigerant channel having a third flow control valve and the motive refrigerant inlet of the ejector connected in that order with a pipe, wherein the refrigerant storing container includes a refrigerant intake pipe inserted from a container upper portion such that an end thereof having an opening is positioned closer to the bottom than the top of the container, and into which the refrigerant flows via the opening; and a refrigerant outflow pipe inserted from the container upper portion such that an end thereof having an opening is positioned closer to the bottom than the top of the container, and out of which the refrigerant flows via the opening and, wherein the refrigerant intake pipe of the refrigerant storing container has at least one refrigerant outflow hole in a peripheral surface thereof at a halfway position between the end having the opening and the container upper portion.

2. The refrigeration cycle apparatus of claim 1, further comprising:

an internal heat exchanger being provided between the refrigerant storing container and the second flow control valve and being connected to the refrigerant storing container and the second flow control valve with pipes; and a bypass being branched off from the pipe connecting the refrigerant storing container and the internal heat exchanger and having a fourth flow control valve and the internal heat exchanger connected in that order, the bypass being connected to a halfway point of the pipe that connects the compressor and the second evaporator after extending through the internal heat exchanger.

3. The refrigeration cycle apparatus of claim 1, wherein the pipe connecting the second evaporator and the compressor extends through the refrigerant storing container.

4. The refrigeration cycle apparatus of claim 1, wherein the refrigerant outflow pipe of the refrigerant storing container has at least one oil return hole in a peripheral surface thereof at a halfway position between the end near the container bottom portion and the container upper portion.

5. The refrigeration cycle apparatus of claim 1, wherein the refrigerant intake pipe of the refrigerant storing container has the opening at the end thereof sealed, the end having an oil suction hole via which compressor oil residing at the container bottom portion is suctioned.

6. The refrigeration cycle apparatus of claim 5, wherein either one of a hydrocarbon refrigerant and a hydrofluoro-olefin refrigerant is employed as the refrigerant.

7. The refrigeration cycle apparatus of claim 1, wherein the ejector includes a needle valve at the motive refrigerant inlet thereof, thereby also functioning as the third flow control valve.

8. The refrigeration cycle apparatus of claim 7, wherein either one of a hydrocarbon refrigerant and a hydrofluoro-olefin refrigerant is employed as the refrigerant.

9. The refrigeration cycle apparatus of claim 1, wherein either one of a hydrocarbon refrigerant and a hydrofluoro-olefin refrigerant is employed as the refrigerant.

10. The refrigeration cycle apparatus of claim 1, wherein the compressor includes an injection port, wherein the refrigeration cycle apparatus further comprises an internal heat exchanger provided between the refrigerant storing container and the second flow control valve and connected to the refrigerant storing container and the second flow control valve with pipes; and a bypass branching off from the pipe that connects the refrigerant storing container and the internal heat exchanger and in which a fourth flow control valve and the internal heat exchanger are connected in that order, the bypass extending through the internal heat exchanger and being connected to the injection port of the compressor.

* * * * *